United States Patent [19]

Ando et al.

[11] 4,168,974

[45] Sep. 25, 1979

[54] ION MODULATION IMAGING INVOLVES PRIOR UNIFORM CHARGING OF SECONDARY RECORDING SURFACE AND CHARGE CONTROL THEREOF

[75] Inventors: Yujiro Ando; Nobutoshi Yoshida, both of Yokohama; Kazuki Tanaka; Katsunobu Ohara, both of Kawasaki, all of Japan

[73] Assignee: Canon Kabushiki Kaisha, Tokyo, Japan

[21] Appl. No.: 884,242

[22] Filed: Mar. 7, 1978

[30] Foreign Application Priority Data

Mar. 15, 1977 [JP] Japan ..... 52-28881

[51] Int. Cl.[2] ..... G03G 13/02

[52] U.S. Cl. ..... 96/1 R; 96/1.4; 355/3 SC; 96/1 C; 427/14

[58] Field of Search ..... 96/1 R, 1.4, 1 C; 355/3 SC, 3 CH; 427/14

[56] References Cited

U.S. PATENT DOCUMENTS 3,543,022 11/1970 Lennon ..... 96/1 C X
3,788,739 1/1974 Coriale ..... 96/1 C
3,997,259 12/1976 Bhagat ..... 96/1 C X

*Primary Examiner*—John D. Welsh
*Attorney, Agent, or Firm*—Fitzpatrick, Cella, Harper & Scinto

[57] ABSTRACT

The present invention aims at improvement in the image forming method, wherein ion current is modulated in an image form, on the basis of which a secondary electrostatic latent image is formed on a recording sheet, an insulated drum, and other recording media, and the thus formed electrostatic latent image is developed. In more detail, the entire region of such sheet and drum where such secondary electrostatic latent image is formed is uniformly charged beforehand to a desired potential, whereby the fogging phenomenon to occur at the time of development, and changes in the formed image which take place due to variations in the modulating quantity of the ion current on account of deterioration in an ion current modulating element can be prevented. Setting of the member to form thereon such secondary electrostatic latent image at a desired arbitrary potential can be done by, for example, varying the voltage to be applied to a grid provided in a corona discharger.

9 Claims, 10 Drawing Figures

ION MODULATION IMAGING INVOLVES PRIOR UNIFORM CHARGING OF SECONDARY RECORDING SURFACE AND CHARGE CONTROL THEREOF

BACKGROUND OF THE INVENTION

1. Field of the Invention

This invention relates to an image forming method using an ion current modulating element such as a photo-sensitive body in the shape of a screen (hereinafter referred to simply as "screen") having a multitude of tiny openings. More particularly, the present invention is concerned with a method for controlling the image conditions on the photo-sensitive body and other like recording media, which is also effective in the image forming method, in which ion current is modulated over a plurality of times by one and the same primary electrostatic latent image.

2. Description of the Prior Art

The most representative electrophotographic techniques known heretofore are classified into the direct method such as the electro-fax method, and the indirect method such as xerographic method. In the image forming method using the abovementioned direct method, the recording member to be used is one that has been subjected to a special treatment, for example, coating of a photoconductive substance such as zinc oxide, etc. on the recording member. On account of this, the image formed on the finished recording member is lacking in its brightness, and the image contrast on its surface has been problematical. Further, owing to the abovementioned special treatment, the recording member has such a disadvantage that, in comparison with common paper, it has a somewhat different sense of touch, and appears to be thick and heavy. Since, in the image forming method due to the latter indirect method, such common paper is used for the recording member to form thereon the desired image, there accrues such advantage that a satisfactory image of high image contrast can be obtained. However, this indirect method has such a disadvantage that, when a toner image is transferred to the recording member, the recording member contacts the surface of the photo-sensitive body, and, moreover, when the residual toner is cleaned, the cleaning device such as a brush, a resilient blade, etc. vigorously contacts the photosensitive body to cause damage to the surface of the photosensitive body at every cleaning operation. As a consequence, the life of the expensive photosensitive body becomes curtailed, which is the cause for increased cost in the image formation.

For removing various disadvantages in the heretofore known electrophotographic techniques, there is such one as disclosed in, for example, Japanese Laid-Open Patent Application No. 48-59840 (corresponding to U.S. Pat. No. 3,713,734). The electrophotographic method as disclosed in this prior art is to utilize a screen in the form of a net or lattice having a multitude of tiny openings in mesh size. The outline of this prior technique is such that the screen is used, through which the ion current is modulated to form an electrostatic latent image on the recording member, after which the recording member with the electrostatic latent image having been formed thereon is developed. That is, according to this electrophotographic method, there is no necessity for developing and cleaning the screen which corresponds to the conventional photosensitive body. Consequently, according to this published electrophotographic method, the screen becomes advantageously usable over an extended period of time. In particular, the method as disclosed in the Japanese Laid-Open Patent Application No. 51-341 (corresponding to U.S. patent application Ser. No. 771,309 and DOLS 2,429,303) has successfully attained improvement in durability of the screen as well as realized image formation by repeatedly utilizing the primary electrostatic latent image, which was once formed, over much more numbers of times than those in the conventional technique (this repeated reproduction operation will hereinafter be called "retention copying"). Although no detailed explanation of that published invention will be given herein, its outline is as follows. First of all, the embodimental construction of this screen is such that a photoconductive member is coated on the electrically conductive base member in a manner to cover the base member with one surface side thereof being exposed to outside, and then an insulating member is provided over the surface of the thus coated electrically conductive member. The image formation is conducted in such a manner that the primary electrostatic latent image formed on the abovementioned screen is utilized to modulate the ion current which has been applied to a chargeable member and to thereby obtain the secondary electrostatic latent image on this chargeable member. For the chargeable member, there may be used electrostatic recording paper and a drum member having thereon an insulating layer as the recording medium (the insulated drum). In case of using the electrostatic recording paper, it is directly developed and fixed by known means, which is used as the reproduced copy. Contrary to this, in the case of using the insulated drum, the secondary electrostatic latent image on the drum is once developed, after which the developed image is transferred to the recording member such as separately provided common paper which will be fixed to serve as the reproduced copy. Therefore, the insulating drum becomes able to be used repeatedly by removing the toner remaining thereon after the image transfer.

By the way, in an image forming device which effects the retention copying by the use of the screen, such as, for example, a reproduction device, there takes place such a situation that the conditions for forming the primary electrostatic latent image becomes deviated from a proper range, which has been established beforehand, due to various changing factors such as difference in the background brightness of an original to be reproduced, changes in environmental conditions surrounding the reproduction device, and others. When the image formation is effected actually under such conditions, the overall image becomes fogged to lower the image contrast, or, conversely, the dark portion in the image (particularly thin lines) is extinguished to result in an ambiguous image. In such a situation, the appropriate image can be obtained by re-adjusting various reproduction conditions such as the amount of image irradiation, amount of electric charge on the screen, and so forth on the basis of detailed inspection of the produced image through the eyes, and then by re-forming the primary electrostatic latent image. This way of obtaining the appropriate image is not preferable, because not only considerable time is wasted for adjustment to set complicated conditions for such adequate image reproduction, but also durability of the screen becomes lowered due to increased number of times of the forming operation of the primary electrostatic latent image onto the screen. Moreover, variations in the forming conditions of the primary electrostatic latent image renders astable the basic conditions for the primary electrostatic latent image formation.

SUMMARY OF THE INVENTION

In view of various problems involved in the heretofore known electrophotographic reproduction method, it is the primary object of the present invention to provide an improved image forming method which can solve various disadvantages inherent in the conventional technique and effect the image formation of a high quality.

It is another object of the present invention, associated with the abovementioned principal object, to provide the image forming method which enables the secondary electrostatic latent image to be changed to a favorable state without changing the forming condition of the primary electrostatic latent image relative to the ion modulating element.

It is still another object of the present invention to provide an improved image forming method capable of constantly performing the clear image formation irrespective of variations in the abovementioned factors in the image forming apparatus by compensating these variables at the time of forming the secondary electrostatic latent image without re-forming the primary electrostatic latent image.

It is other object of the present invention to provide an improved image forming method which does not cause undesirable fogging phenomenon on the formed image without applying a bias voltage to the developing means.

It is still other object of the present invention to provide a preferable image forming device and preferable image forming conditions for the device, the device being simple in its construction to effect the abovementioned image forming method, and being capable of performing accurate image control.

The present invention to attain the above described objectives is characterized by the following. That is, when ion current to be applied to a recording medium having a charge sustaining capability by means of a modulating element which modulates the ion current in the form of an image, control of the electrostatic latent image to be formed on the recording medium in a satisfactory condition is done by previously charging the surface of this recording medium to a predetermined potential. In effecting the abovementioned method, even when the ion modulating element, for example, becomes deteriorated, and the quantity of ion to be modulated is varied, a satisfactory secondary electrostatic latent image can be formed by adjusting the charged potential on the surface of the abovementioned recording medium with the condition for the primary electrostatic latent image remaining as it is. Also, when the electric field for the modulation is varied due to its deterioration during performance of the retention copying, for example, and the quantity of the modulated ion has been changed, the conventional method re-forms the electric field for the ion modulation at that point to further continue the retention copying. However, according to the present invention, the variant portion of the modulated ion quantity caused by variation in the modulating electric field can be compensated by the charged potential established on the recording medium. On account of this, time and labor for re-forming the electric field for the modulating element can be dispensed with, even when the quantity of the modulated ion becomes varied at the time of the retention copying as has been experienced in the conventional technique.

Further, another great characteristic of the present invention is that, when, for example, the recording medium is previously uniformly charged in the negative (−) polarity, on which the ion current of the positive plarity (+) is modulated, there can be formed the secondary electrostatic latent image having the opposed polarities at both bright and dark sides of the image. Owing to this, even if the bias voltage at the time of development is brought to a grounded condition, in which the developing means takes the simplest construction, there occurs no fogging phenomenon, and the secondary electrostatic latent image on the recording medium can be developed clearly.

As stated in the foregoing, a corona discharger is very common and general as the device of uniformly charging the recording medium before the ion current modulation. Therefore, there are various methods for controlling the charge quantity such as by varying the voltage to be applied to the corona discharger, or by using the corona discharger having a grid means so as to vary the bias voltage to the grid. In particular, the method, in which the grid is used to set the recording medium at a desired potential, is effective. The reason for this is that a constant corona ion is always generated from the corona discharge electrode, the arriving quantity of which at the recording medium is adjusted by the grid positioned near the recording medium, whereby a stable and highly precise charged potential can be established.

Thus, with a quantity of the modulated by the ion modulating element and the potential of the previously charged recording medium, it is possible to form the secondary electrostatic latent image in the most satisfactory condition. Also, it is always possible by the abovementioned method to form a stable image without changing various conditions for the primary electrostatic latent image forming means, or changing the bias voltage to the developing device.

Furthermore, it can be contemplated that the developing device is caused to float electrically in accordance with variations in the secondary electrostatic latent image to vary the bias voltage to this developing device, thereby obtaining a definite image as the result.

For the ion current modulating element, there may be used a screen having a multitude of tiny passage openings, beside the elements which effect the ion current modulation by the use of the slit-shaped element as disclosed in Japanese Laid-Open Patent Application No. 49-121544. Also, for a general construction of the grid means for use in the discharger to charge the recording medium at a certain definite potential, there may be used a metal plate with a plurality of thin slits or a multitude of tiny openings being provided therein. The grid means (hereinafter simply called "grid") is at the side of the recording medium in the corona discharging means, and is positioned in a non-contact relationship with the recording medium. It renders uniform the electric potential on the recording medium by controlling the quantity of the corona ion to the recording medium by the abovementioned corona discharging means through the grid. Incidentally, as one form of the abovementioned recording medium, there is such a member that has a chargeable layer on the surface of the insulated drum, the photosensitive drum, etc., and is used repeatedly by application of developing, transferring, and cleaning means thereto. From the standpoint of configuration, it is, of course, admitted that not only the drum shape, but also an endless web shape or long winding belt may be adopted. The other form of the recording medium is such that the medium itself may be in the sheet form to be utilized by development and fixation.

For a preferred form of the grid to be provided in the corona discharge means mentioned in the present invention, there may be used one that is constructed with a plurality of thin wire electrodes. A preferred interval between the mutually adjacent thin wire electrodes may be in a range of from 0.5 to 1.5 mm. A distance between these electrodes and the recording medium may be substantially the same as the interval between the mutually adjacent electrodes, and a width l of the corona discharge means with respect to the moving direction of the recording medium is established at $l=4\ vdK/t$ (unit of measurement: mm), where: d represents an interval between mutually adjacent electrodes to constitute the grid, the unit of measurement of which is in multi-meter (mm); t denotes thickness of the chargeable member of the recording medium, the unit of measurement of which is in micron ($\mu$); K denotes dielectricity; K/t indicates an effective thickness of the chargeable member, the unit of measurement of which is in micron ($\mu$); and v represents a moving speed of the recording medium, the unit of measurement of which is in cm/sec.

The foregoing objects, other objects as well as the detailed construction and function of the present invention will become more clearly understandable from the following description of the preferred embodiments of the invention, when read in conjunction with the accompanying drawing.

DETAILED DESCRIPTION OF PREFERRED EMBODIMENTS

Figure 1:
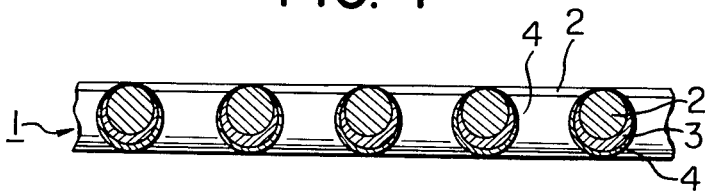
FIG. 1 is an enlarged cross-sectional view of a screen for explaining the embodiment of the present invention.

FIG. 1 shows one embodiment of the screen for use in the present invention, the construction of which is shown diagrammatically by an enlarged cross-section. In the drawing, the screen 1 is so constructed that a photoconductive member 3 and an insulating member 4 to be the outermost coating are coated in a laminar form on an electrically conductive member 2 such as metal net, etc. having a multitude of tiny openings in such a manner that one surface side of the electrically conductive member may be exposed to outside.

FIGS. 2 to 5 shows one example of a latent image forming process by means of the abovementioned screen 1, detailed explanation of which is omitted in view of the prior application which has already been laid open to public inspection. In this specification, explanations will be made as to an example, wherein the abovementioned screen 1 has such a characteristic that the hole is injected into its photoconductive member. In other words, it is assumed that the photoconductive member 3 is of a semiconductive material such as selenium (Se) or its alloys, etc. with the hole as their principal carrier.

Figure 2:
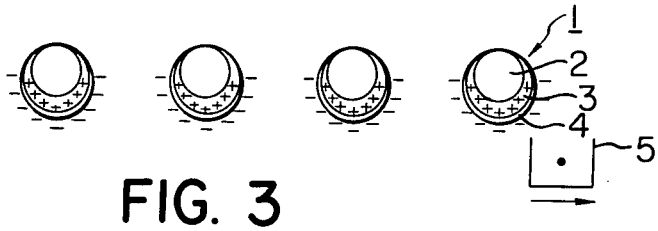
FIGS. 2 to 4 are respectively schematic diagram to explain a primary electrostatic latent image forming process by the screen shown in FIG. 1.

FIG. 2 shows a result of effecting the primary voltage application process, in which the insulating member 4 of the abovementioned screen 1 has been uniformly charged in the negative (−) polarity by means of a known charging means. By this charging operation, the hole is injected into the photoconductive member 3 through the electrically conductive member 2, and a charged layer is formed at the interface in the vicinity of the insulating member 4. In the drawing, a reference numeral 5 designates a corona discharger.

Figure 3:
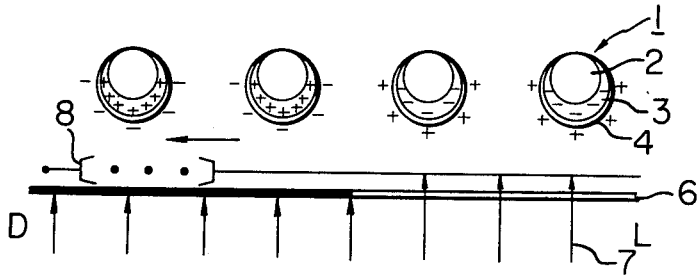

FIG. 3 shows a result of effecting the secondary voltage application process and the image irradiation process almost simultaneously, in which a corona discharge with a voltage obtained by superposing a bias voltage of the positive polarity onto an AC voltage as the power source is used for the secondary voltage application.

Besides the AC voltage, the voltage to be applied may also be a DC voltage of the opposite polarity to the abovementioned primary voltage. Also, when the dark attenuation characteristic of the photoconductive member 3 is slow, the abovementioned voltage application and image irradiation can be done not only simultaneously, but also sequentially. In the drawing, a reference numeral 6 designates an original image to be reproduced, a letter L refers to a bright portion thereof, a letter D to a dark portion, and numerals 7 and 8 designate light rays and corona discharger, respectively.

Figure 4:
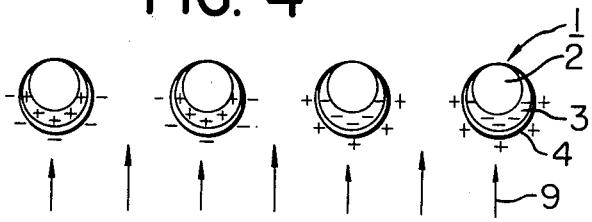

FIG. 4 shows a result of effecting an overall light irradiation on the screen 1, wherein the surface potential of the screen 1, at only the dark portion thereof, changes rapidly to a potential proportional to the surface charge quantity of the insulating member 4 to thereby form the primary electrostatic latent image. In the drawing, a reference numeral 9 designates light rays.

Figure 5:
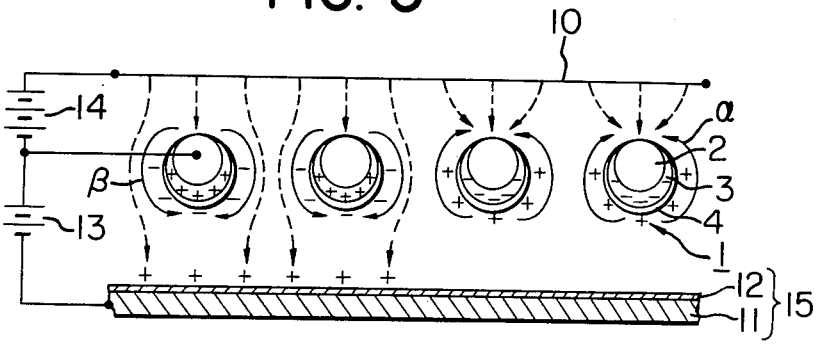
FIG. 5 is a schematic diagram to explain the forming process of a secondary electrostatic latent image by the same screen.

FIG. 5 indicates a state, wherein ion current has been modulated by the abovementioned primary electrostatic latent image, and a positive image of the original is thereby formed on the recording medium. In the drawing, a reference numeral 10 designates a corona wire, and 15 refers to a recording medium which consists of an insulating layer 12 and an electrically conductive substrate 11 for holding the charge. Reference numerals 13 and 14 designate power sources. The recording medium 15 is placed at a position in the vicinity of the side of the insulating member 4 of the screen 1 so that the ion current from the corona wire 10 disposed by way of the screen 1 may be applied to the recording medium 12 in utilization of a potential difference between the corona wire 10 and the electrically conductive substrate 11. In this case, an electric field to impede the ion current (shown in solid line $\alpha$) acts on the bright portion of the original image by means of the charge of the primary electrostatic latent image on the screen 1, while an electric field to permit passage of the ion current (shown in solid line $\beta$) acts on the dark portion of the original image, whereby the secondary electrostatic latent image which is a positive image of the original is formed on the recording medium 15. When the screen 1 of the above-described construction is used, the primary electrostatic latent image is formed on the insulating member, so that it becomes possible to increase the electrostatic contrast due to the electric charge quantity to a very high level. In addition, since attenuation of the latent image charge which has been further formed can be reduced to the minimum possible, the retention copying in more number of times than in the conventional recording medium becomes possible. Incidentally, when the polarity of the power sources 13 and 14 in FIG. 5 is made opposite each other, the negative ion passes through a region corresponding to the bright portion of the image, whereby a negative image is formed on the recording medium 15. Also, in the formation of the primary electrostatic latent image, if the screen 1 is so made that a semiconductive material such as cadmium sulfide (CdS) with electron as the principal carrier therefor is used for the photoconductive member 3 so as to cause the electron to be injected even in the dark portion of the original image, application of the primary voltage is, of course, opposite to that in the above-mentioned example, and the voltage to be applied at the time of the secondary electrostatic latent image formation is totally carried out in the opposite polarity.

Figure 6:
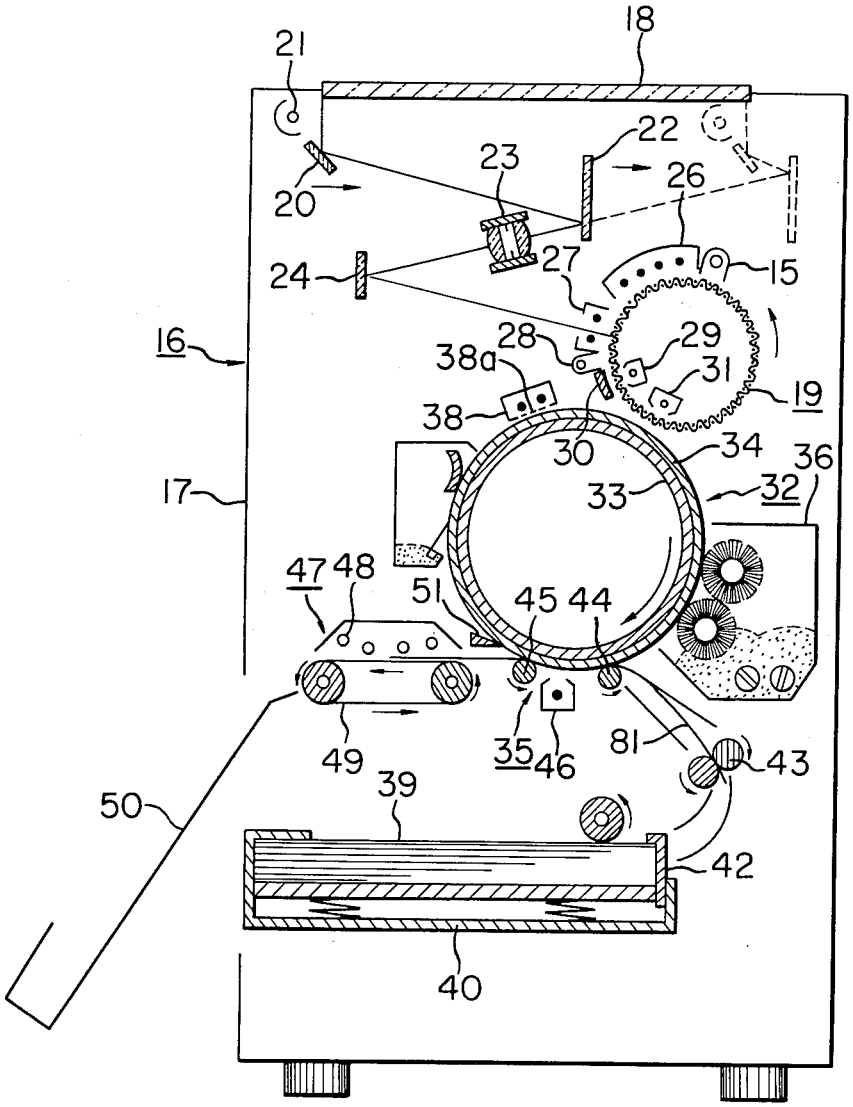
FIG. 6 is a cross-sectional view showing a schematic construction of a reproduction apparatus, in which the screen of FIG. 1 is adopted.

In the following, examples will be given as to the reproduction apparatus using the screen of the construction shown in FIG. 1. The image forming device shown in the drawing as one embodiment is such a reproduction apparatus 16 that forms a reproduced image on a plain paper in utilization of the latent image forming processes as have been explained in reference to FIGS. 2 to 5. Each and every part of this reproduction apparatus is shown in cross-section in the drawing. In FIG. 6, a reference numeral 17 designates an external wall or casing of the reproduction apparatus 16, on top of which there is provided an original image mounting table 18 made of a transparent member such as glass, etc. This original mounting table 18 is of a fixed type, and the image irradiation to the screen 19 is carried out by partial shifting of optical means. This optical means is of a known type, in which a first mirror 20 and an original illuminating lamp 21 are caused to shift from their positions in solid lines upto their rightmost positions in dotted lines at a speed V to cover the total distance of the abovementioned original mounting table 18. On the other hand, a second mirror 22 is caused to shift at a speed of V/2 from its position in solid lines to its rightmost position in dotted lines simultaneously with shifting of the first mirror 20 scanning the surface of the original image. The original image scanned by the first and second mirrors 20 and 22 is introduced onto the screen 19 through a lens system 23 having an aperture mechanism and a fixed mirror 24. Incidentally, the abovementioned screen 19 is formed in a drum shape so that the surface of the electrically conductive member exposed outside may be faced inwardly of the cylindrical screen. In the vicinity of the screen 19, there is disposed a latent image forming means along the rotational direction of the screen 19. In the drawing, a reference numeral 25 designates a pre-exposure lamp which is provided for using the photoconductive member constituting the screen 19 in a constantly stable photo-hysteresis state. A reference numeral 26 designates a corona discharger which is the primary voltage application means, and which charges the rotating screen 19 to a satisfactory voltage level. A reference numeral 27 indicates another corona discharger which is the secondary voltage application means, and which irradiates the original image, while removing the electric charge on the screen 19 charged by the corona discharger 26. For this purpose, this corona discharger 26 is of such a construction that a shielding plate at the back surface thereof is optically open. A numeral 28 refers to a lamp for overall irradiation of the image which illuminates the screen 19 in a uniform manner to rapidly increase the electrostatic contrast in the primary electrostatic latent image. By the above-described manner, there can be formed on the screen 19 the primary electrostatic latent image having a high electrostatic contrast. A corona discharger 29 disposed inside the cylindrical screen 19 is used for removing harmful electric charge adhered to, or accumulated on, the screen 19 by a modulating corona discharger 31 during the retention copying. A reference numeral 30 designates an opposite electrode which is positioned in confrontation to the abovementioned corona discharger 29 through the screen 19. The electrode 30 serves to prevent the primary electrostatic latent image on the screen 19 from extinction at the time of removal of the electric charge.

The secondary electrostatic latent image is formed on an insulated drum 32 which is a rotating recording medium in the arrowed direction by means of the modulating corona discharger 31. Incidentally, the insulated drum 32 is of such a construction that an insulating layer 34 is coated on an electrically conductive substrate 33. This insulated drum functions to apply a voltage between the electrically conductive substrate and the electrically conductive member of the screen 19, and to introduce the modulated corona ion to the surface of the insulating layer 34. The secondary electrostatic latent image thus formed on the insulating layer 34 is developed by a known developing means 36 to be a toner image. The toner image is then transferred onto an image transfer material 39 which has been carried to an image transfer position 35 in synchronism with the toner image. The insulated drum 32 which has completed the image transfer process is thereafter cleaned by a known cleaning means 37 to remove residual toner thereon, after which it is rendered by a corona discharger 38 to be in a uniform surface potential for the subsequent reproduction process. The abovementioned corona discharger 38, as will be described later, is controlled its discharge quantity by a grid 38*a*. Its control is also possible to a certain extent by adjustment of a voltage to be applied to the corona discharge electrode. By the use of the grid 38*a*, as in the present embodiment, fine adjustment of the applying voltage becomes possible, whereby the surface potential on the insulated drum 32 can be accurately set at a desired potential.

For the developing means, there may be used either a dry type or wet type developing means. For the cleaning means, either blade or brush, or else may be used. The image transfer material 39 to be conveyed to the image transfer position 35 is loaded in a cassette 40, which is separated, sheet by sheet, by means of a roller 41 and a separating pawl 42, the thus separated sheet being conveyed by a register roller 43 in correspondence to the abovementioned position of the toner image. In the drawing, a reference numeral 44 designates a conveying roller, and a numeral 45 refers to a corona discharger for image transfer which is for applying a bias voltage to the image transfer material 39 at the time of transferring the toner image. After the image transfer, the image transfer material 39 is separated from the insulating drum 32 by means of a separating pawl 51 and forwarded to a fixing means 47 where it is subjected to toner image fixation by a heating means 48. The thus image-fixed transfer material 39 is conveyed to a receiving tray 50 for receiving the finished image transfer material. When the retention copying is to be effected, only the process after the secondary electrostatic latent image forming process can be repeated, so that a high speed reproduction operation becomes possible.

In the present invention, the surface potential of the insulating drum 32 which is the recording medium is charged to a predetermined potential by means of the corona discharger 38 in advance of the secondary electrostatic latent image formation. Hence, in the embodiment shown in FIG. 6, the amount of corona discharge from the corona discharger 38 is varied by controlling the voltage to be applied to the grid 38*a* to thereby form the secondary electrostatic latent image in an adequate state. Incidentally, there are two reasons for the impropriety of the abovementioned primary electrostatic latent image. The first is a case, wherein an original image having a colored background is desired to be reproduced in a non-colored background. Generally speaking, the forming condition of a standard or reference primary electrostatic latent image which has been set in the reproduction apparatus beforehand is based on an original having a non-colored background. In such a case, therefore, there appears a fogging (coloring) on the background of the reproduced copy which is the finished image. As a counter-measure to this fogging phenomenon, the potential of the recording medium is differentiated for a potential, by which the fogging takes place, without operating the bias voltage of the developing means, whereby the undesirable fogging in the reproduced copy can be eliminated with the bias voltage of the developing means as it is. The second is a case, wherein the physical conditions such as corona discharge, electrical resistance value of the screen, and others fluctuate due to environmental changes such as temperature, humidity, and other causes, whereby the state of the primary electrostatic latent image varies. Even in such case, wherein the primary electrostatic latent image changes to a tendency of causing the fogging phenomenon, if the potential of the recording medium prior to formation of the secondary electrostatic latent image is differentiated, a reproduced copy of a proper condition can be obtained. On the contrary, when the primary electrostatic latent image is varied to a tendency where the image extinguishes, no adequate image can be obtained, even if the potential of the recording medium is varied. Considering such situation, it may be better to shift the standard conditions in the reproduction apparatus for the primary electrostatic latent image formation to a tendency where the fogging possibly takes place for a variable portion to usually occur. Now, therefore, if the potential on the recording medium prior to formation of the secondary electrostatic latent image is shifted as mentioned above, the primary electrostatic latent image can be actually maintained in an adequate state without its being extinguished, even when the condition for the primary electrostatic latent image varies to a tendency where the image extinguishes. However, since the standard condition is still in a state of the fogging tending to occur, when the surface potential of the recording medium is set as mentioned above, it becomes necessary to remove the potential to cause the fogging to occur by varying and adjusting the potential on the recording medium.

In the following, explanations will be given for a concrete means to make the surface potential of the recording medium according to the present invention.

The simplest means is to utilize a conventional corona discharger, to control a voltage to be applied thereto, and to adjust the charged potential to the recording medium. A preferred voltage to be applied to the corona discharge electrode is one that has a polarity opposite to that of the corona ion to be modulated, and that the abovementioned recording medium is so set that it may be charged to an opposite polarity to that of the modulated ion, whereby the potential at the background portion of the image and that at the image portion thereof may be in the rightly opposite relationship. When the recording medium which has thus image-formed with such potential is developed, there can be obtained a clear reproduction image free from the fogging. Incidentally, the form of the current to be applied to the discharge electrode of the abovementioned conventional corona discharger can be not only a direct current of a single polarity, but also a superposed current of an alternating current and a direct current, wherein the tension of the direct current is controlled to adjust the potential on the recording medium. Also, the method of changing the discharge quantity from such conventional corona discharger is such that, besides a method of changing the applied voltage to the abovementioned discharge electrode, an applied voltage to the shield plate of the corona discharger may be changed.

For the charging means in place of the corona discharger, there are several kinds such as a roller charging means, a frictional charging means using a brush-shaped member, and others. While these contact and friction type charging means are not suitable for charging to such a high tension which is as high as several thousand volts, it may serve well its purpose when they are used to establish the surface potential of the recording medium in a range upto several hundred volts.

Incidentally, as a preferable method for charging the surface potential of the recording medium to a predetermined desired potential, there may be used a corona discharger having a grid therein. Therefore, in the following, detailed explanations will be given as to the charging method of the recording medium using such corona discharger having the grid as well as the construction of such discharger.

Figure 7:
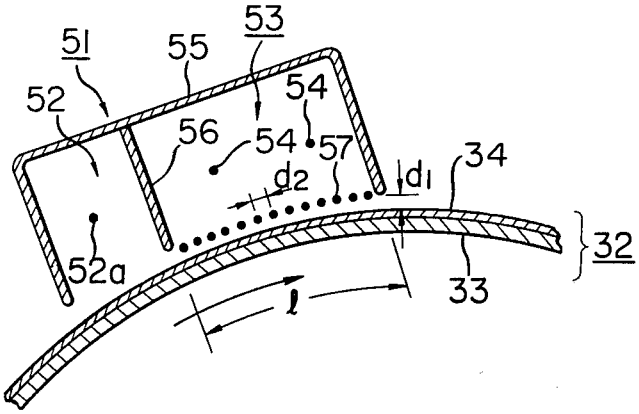
FIG. 7 is a cross-sectional view showing one embodiment of a corona discharger to embody the first means according to the present invention.

FIG. 7 shows a cross-section of one example of the corona discharger suitable for the present invention, in which a discharger 51 corresponding to the discharger 38 in FIG. 6 has two-stage corona dischargers for the first and second corona. In the drawing, the discharger 51 has a first corona discharging chamber 52 and a second corona discharging chamber 53, a high tension voltage having mutually different polarity being applied to each of the discharge electrodes 52*a* and 54 in each of the discharge chambers.

A reference numeral 55 designates an outer wall which constitutes the discharger, wherein the first chamber 52 and the second chamber 53 are construted as a single integral discharger, and is divided into the respective first and second chambers 52, 53 by an internal partition wall 56. It goes without saying that these first and second discharge chambers may be independently provided at separate locations. In the drawing, a reference numeral 57 in the second corona discharge chamber 53 to the side of the insulating drum 32 designates grids which are connected to an arbitrary potential to control the surface potential of the insulating drum 32.

The reproduction apparatus 16 in FIG. 6, in which the abovementioned corona discharger 51 is employed, is on the assumption that cadmium sulfide (CdS) resin dispersion layer is used as the photoconductive member of the screen 19, on account of which corona ion in the negative polarity is generated from the modulating corona discharger 31 to form a positive secondary electrostatic latent image. Under the abovementioned established conditions, the discharge polarity of the corona discharger 51 is such that the positive voltage is applied to the discharge electrode **52*a* and the negative voltage to the discharge electrode 54. Incidentally, since it is sufficient that the corona discharge to be generated from the corona discharge electrodes 52*a* and 54** may be substantially opposite in polarity, there may be used an alternating current superposed with a bias voltage as the applying voltage.

Figure 8:
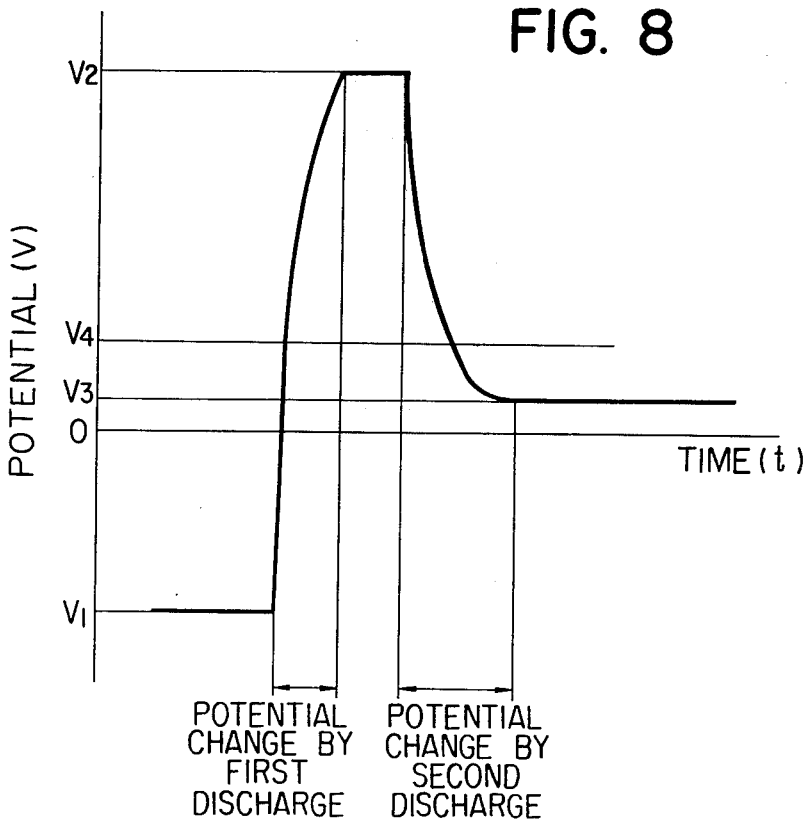
FIG. 8 is a graphical representation for explaining changes in a potential curve, in which the potential change on an insulated drum in the vicinity of the corona discharger of FIG. 7 is shown.

In the secondary electrostatic latent image, when the dark portion of the original image is in the negative polarity, it is preferable to maintain the bright portion thereof in the positive polarity from the standpoint of preventing the fogging phenomenon to take place as the result of the image development. If, on the contrary, the bright portion forms the secondary electrostatic latent image with a zero or a negative potential with respect to the abovementioned dark portion, a bias voltage should be applied to the developing means in order to prevent the fogging phenomenon, for which the developing means should be insulated totally from the main body per se, hence method of mounting the same in the reproduction apparatus would become complicated. In the present invention, however, it is also possible to control the polarity of the secondary electrostatic latent image so that the dark portion and the bright portion of the original image may be directly opposed each other so as to obtain good image with the developing means in a grounded state. In other words, it is sufficient that a voltage having a polarity opposite to that of the voltage to be applied to the corona discharge electrode 54 be applied to the grid 57 of the abovementioned corona discharger 51. In this case, the potential of the insulating drum 32 varies as shown in FIG. 8. The graphical representation in this figure of the drawing shows a state of the surface potential of the insulating drum 32 in the vicinity of the corona discharger 51 with the potential being on the ordinate and the time on the abscissa. Here, also, explanation will be given as to the photoconductive member of the screen which utilizes cadmium sulfide (CdS). The surface potential of the insulated drum 32 which takes a potential $V_1$ by the negative corona discharge for image transfer, which has been imparted to the image transfer material by the corona discharger 46 for image transfer at the time of such transfer operation, first receives the positive corona discharge by the discharge electrode **52*a* in the first corona discharge chamber position to be turned into a positive potential $V_2$. Subsequently, the insulating drum 32 receives a negative corona discharge from the discharge electrode 54 in the second corona discharge chamber position to be turned to a potential $V_3$ for the background portion which is lower than the potential $V_2$ and is suited for the development. For this purpose, it is sufficient that a voltage $V_4$ to the side of the voltage $V_2$ be applied to the grid 57 rather than the voltage $V_3$. The potential $V_3$ is determined by the condition of the developer used in the developing means, which is usually 0 to 100 V or so. A potential difference between $V_4$ and $V_3$ depends on the shape of the grid 57** and its set position. When the linear interval of the grid is fairly small, the relationship between $V_4$ and $V_3$ may become opposite to that shown in the drawing.

The grid 57 may be fabricated in various shapes such that thin wires are extended in parallel or non-parallel with the corona discharge electrode 54, or they are woven in a network form, and others. The following explanations of the grid will be given with an example of its being extended in parallel with the corona discharge electrode. The important factors with such grid 57 are an interval $d_1$ between the grid 57 and the insulating drum 32, an interval $d_2$ between the adjacent grids, and an area where the grid 57 is extended, i.e., a width l for arranging the grid in the rotational direction of the insulating drum 32 (hereinafter called "grid width"). Although it may be contemplated with respect to the grid 57 that it be provided at the center part thereof or more at either side thereof within the predetermined grid width l, the results of experiments revealed that no remarkable effect could be obtained on the increased stability of the potential after removal of the charge, or narrowing the grid area, even if disposition of the grid 57 is modified. Of the abovementioned factors, the interval $d_1$ between the grid 57 and the drum 32 and the interval $d_2$ between the mutually adjacent grids should preferably have substantially the same values. If the interval $d_1$ assumes a value 1.5 times or higher than, or particularly 2 to 3 times as high as, that of the interval $d_2$, the quantity of electric current to flow to the insulated drum 32 through the grid 57 becomes remarkably reduced. On account of this, when the grid 52 is set at 1.5 times or more as mentioned above, the grid width l should be made very wide. However, by providing the grid width l wide enough, there arises such an effect that the exposure time of the drum surface to the corona discharge is prolonged and the potential of the insulated drum 32 becomes highly stable. On the other hand, when the interval $d_1$ becomes half, or 0.7 times or less as low as, that of the interval $d_2$, the controlling effect of the potential due to the grid becomes reduced and the variations in the potential after passage of the corona discharger becomes large. In order therefore that a preferable result may be practically obtained, the interval between the mutually adjacent grids should preferably be taken at an interval of 0.5 to 1.5 mm or so.

Figure 9:
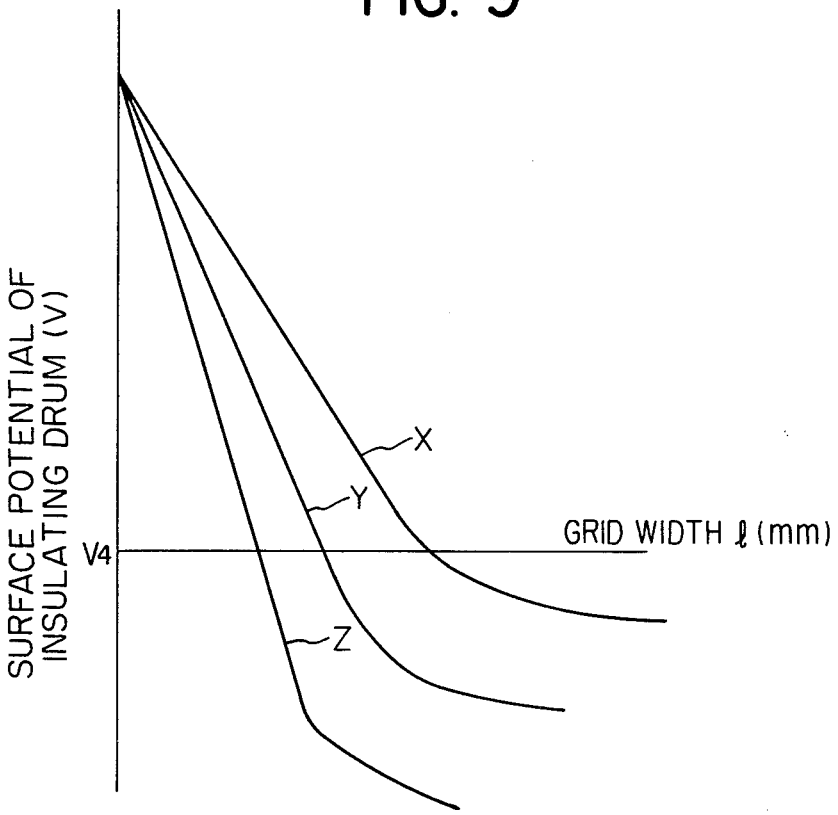
FIG. 9 is a graphical representation showing a relationship between a grid voltage and a grid width in controlling the charged potential on the chargeable member.

FIG. 9 is a graphical representation showing potential variations on the chargeable member due to the corona discharger for use in the present invention. The experimental results shown in this graphical representation are those of the corona discharger shown in FIG. 7 as one example. In the graph, the ordinate represents the surface potential (unit of measurement: V) of the insulating drum, the abscissa denotes a grid width (unit of measurement: mm) of the corona discharger, and a symbol $V_4$ indicates a voltage (unit of measurement: V)

applied to the grid 57. In the abovedescribed corona discharger 51, when the interval $d_1$ becomes wider than the interval $d_2$, the surface potential of the insulating drum varies as shown by a curve (X). On the contrary, when the interval $d_1$ becomes less than half, i.e., 0.7 times or less, the interval $d_2$, the potential variation will become as shown by a curve (Z), whereby, while the potential variation of the insulating drum becomes rapid, the time for the potential variation to be in a saturated state becomes delayed, and, moreover, stability of the surface potential of the drum will be infereior to a state, wherein the interval $d_1$ is larger than the interval $d_2$. From general consideration of the above experimental results, the intervals $d_1$ and $d_2$ should preferably be set at substantially equal values. Contrary to this, the time t (unit of measurement: second) required for the discharge is proportional to the circumferential speed v (unit of measurement: cm/second) of the insulating drum, electrostatic capacitance of the insulating layer 34 of the insulating drum 32, and the interval $d_1$ ($\alpha d_2$), and is inversely proportional to intensity of the corona discharger 53 and permissible fluctuation of the potential after removal of the charge. Incidentally, the permissible fluctuation of the potential on the insulated drum 32 may be in such a range that no influence will be caused to the developed image after the development. In the apparatus as in the abovedescribed embodiment, it should preferably be in a range of about 10 to 20 volts. Further, by setting the permissible range as mentioned above to maintain high stability of the image, the potential of the insulated drum may vary in accurate correspondence to variations in a voltage to be applied to the grid. On the other hand, it goes without saying that intensity of the corona discharge due to the corona discharger 53 has a limitation in that it should be safely operated without causing spark discharge.

As the result of conducting experiments based on the abovementioned various conditions, it has been found out that the grid width l with respect to the moving direction of the recording medium should be higher than a value obtained from the following equation: 4 vdK/t (unit of measurement: mm) for restricting the fluctuation of the potential after removal of the charge to 10 volts or so, where: the interval d of the grid is represented by a unit of measurement of "mm"; a value of t/K, which is a value corresponding to electrostatic capacitance of the recording medium such as the insulated drum, and which is obtained by dividing a thickness t of the chargeable layer by its dielectricity K, is denoted by a unit of measurement of "micron"; and a speed of the recording medium is indicated by a unit of measurement of "cm/sec.". As an example, when d is 2 mm, t is 25 microns, K is 3, and v is 40 cm/sec., the grid width l to obtain the preferred result is found to be about 40 mm at the minimum, or preferably 50 mm. In this example, when the value of t is changed to 12 microns, the grid width l required to obtain the preferred result is approximately 80 mm and above, or preferably 100 mm. When the grid interval d is altered to 1 mm, the grid width l could be reduced to 40 mm, or preferably 50 mm. Incidentally, it is possible in the abovedescribed example of FIG. 7 that the positive corona discharge be generated from the corona discharger 52 without use of the corona discharger 51 so as to change the potential directly from $V_1$ to $V_3$. This direct change from $V_1$ to $V_3$ can be done by applying to the grid a potential to the side of $V_1$ for a value $V_4-V_3$ with respect to $V_3$.

In order to enable skilled persons in the art to reduce the present invention as has heretofore been described into practice, the following actual example will be presented, although the invention is not limited to this embodiment alone, but any changes and modifications may be made within the spirit and scope of the invention as set forth in the appended claims.

(EXAMPLE)

In the image forming apparatus of a construction as shown in FIG. 6, only the corona discharger 38 was replaced by the corona discharger of a construction as shown in FIG. 7. For the screen 19, there was used the screen shown in FIG. 1 which was fabricated by applying CdS resin dispersion layer as the photoconductive member onto the base body of stainless steel thin wire net of 250 meshes, and by further coating an insulating member over the surface of the photoconductive member. The primary electrostatic latent image on this screen was in the positive polarity which, when the surface potential at the bright portion of the image became −50 volts under a proper exposure, was turned into a state that did not allow the modulating ion current to pass therethrough at all. From this state, the discharging condition of the corona discharger 27 for the secondary voltage application was changed so that the potential at the bright portion of the image may be −30 volts. By this operation, an amount of current which corresponds to approximately 5% of the ion current usually passing through the dark portion of the image on the screen became passable through the bright portion of the image on the screen. The developing device 36 for developing the secondary latent image was of a magnetic brush type using magnetic toner, the brush portion of which was grounded. In this state, when the secondary electrostatic latent image was formed by bringing the overall surface potential of the insulating drum 34 uniformly at +70 volts or so, no fogging could be seen to have generated on the developed image. In the actual example, when a voltage of +7 kV was applied to the discharge electrode 52*a* of the abovementioned corona discharger 51 under the surface potential $V_1$ of the insulating drum 32 being −200 volts after its passage through the image transfer corona discharger 46 shown in FIG. 6, the potential $V_2$ became +300 volts. At this time, thin tungsten wire of 0.1 mm in diameter was stretched at an interval of 1 mm to constitute the grid 57 for the corona discharger 51, and the thus formed grid was then positioned over the surface of the insulating drum 32 at an interval of 1 mm from its surface. Then, when a voltage of +200 volts was applied to the grid 57 and a voltage of −8 kV was applied to the discharge electrode 54 of the discharger 53, the potential $V_3$ became +60 volts, and the optimum state could be obtained for the reproduced image free from the fogging, when no ion current passes through the screen.

In the state, wherein the bright portion of the primary electrostatic latent image was made −30 volts on the screen drum, there occurred an electrostatic fogging phenomenon. However, when the voltage to be applied to the grid was changed from +200 volts to +220 volts, and the surface of the insulating drum was uniformly charged to +80 volts with a potential prior to formation of the secondary electrostatic latent image, the fogging extinguished from the developed image of the secondary electrostatic latent image, and an image could be obtained. On the other hand, when an original image having the background in light yellow, light blue, etc. was used, very satisfactory reproduced image free from the fogging could be similarly obtained, even if the secondary electrostatic latent image was formed by the use of the primary electrostatic latent image formed under the same conditions by increasing the applying voltage to the grid in the range of from +250 volts to +300 volts. Furthermore, even when the corona discharger, the screen, and other component members of the reproducing apparatus changed their characteristics and conditions due to environmental variations and changes due to time-lapse, whereby the state of the primary electrostatic latent image also changed, the extent of the changes is within 20 volts or so in terms of the potential of the primary electrostatic latent image at the bright portion of the image. On account of this, even when the latent image potential varies toward the maximum negativity, there occurred no situation such that the image become extinguished, and a proper reproduced image free from the fogging could be obtained by lowering the applying voltage to the grid to a range of from 180 to 200 volts.

As stated in the foregoing, by the use of the corona discharger having the grid means when the surface of the recording medium is to be set at a predetermined potential to control the potential to be applied to this grid means, it becomes possible to establish the charged potential on the recording medium by the corona discharger to thereby adjust the secondary electrostatic latent image on the recording medium, hence the image condition of the developed image. In the image forming apparatus having no developing means, it is possible to aim at adjustment of the secondary electrostatic latent image.

Incidentally, according to the present invention, when a screen capable of performing the retention copying is used, there arises the situation that the primary electrostatic latent image attenuates by passage of the modulating ion, or, even when the quantity of the passing modulating ion current changes due to its attenuation by the environmental changes, the image correction becomes possible by adjusting the surface potential on the side of the recording medium. In other words, since this primary electrostatic latent image is not necessary to be re-formed at the time of the change in this primary electrostatic latent image, the frequency of use of the screen can be decreased, as the result of which durability of the screen can be increased. Thus, the present invention exhibits the abovementioned effect by combination of the screen capable of the retention copying. Also, the present invention is effective not only to the retention copying, but also to such a screen that is capable of forming the secondary electrostatic latent image only once from an ordinary primary electrostatic latent image once formed. For example, when the forming conditions of the primary electrostatic latent image such as applying quantity of the corona discharge, image exposure quantity, etc. are fixed in advance, even if there should occur deterioration in the screen due to lapse of time in use, or even if the background of the original image is other than white, or even if there should occur increase and decrease in the passing ion current due to change in the environmental conditions, necessary correction can be made at the time of the second electrostatic latent image formation, whereby the secondary electrostatic latent image free from the fogging can be formed. In other words, since it is sufficient that the charge potential to the recording medium be controlled without changing the forming conditions of the primary electrostatic latent image, the controlling method and the device construction become simple. Also, in case of carrying out the image quality adjustment by the grid means of the corona discharger which is in a non-contact state with respect to the chargeable member, there exists no apprehension at all of the occurrence of short-circuiting between the voltage application member and the chargeable member, hence possible damage to the surface of the chargeable member can be avoided.

Figure 10:
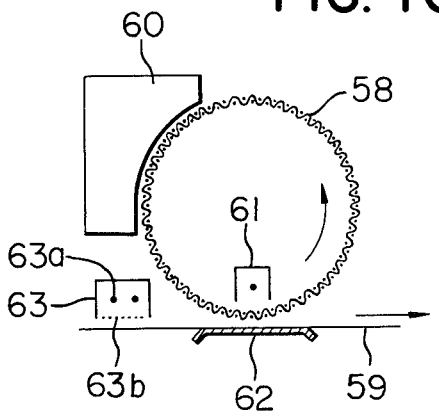
FIG. 10 is a cross-sectional view showing a schematic construction of another embodiment of the device according to the present invention.

In the foregoing, the present invention has been explained with reference to a particular embodiment, wherein an intermediate recording medium capable of repeated use is employed, although the invention is also possible by the combination of a screen 58 and a chargeable sheet 59 such as electrostatic recording paper as the recording medium as shown in FIG. 10.

In this figure of drawing, a reference numeral 60 designates a primary electrostatic latent image forming means, a numeral 61 refers to a corona discharger which generates modulating ion current, 62 indicates an opposite electrode to the corona discharger 61, 63 denotes a corona discharger having the grid to practise the present invention, 63*a* refers to a discharge electrode, and 63*b* designates the grid. In the illustrated device, the cylindrical screen 58 rotates in the arrowed direction, and the chargeable sheet 59 is sequentially carried in the arrowed direction, whereby the secondary electrostatic latent image on the recording sheet is developed later by a developing means (not shown). In other words, it is possible to carry out the ultimate image adjustment by setting the potential of the sheet 59 to a predetermined value through the grid of the abovementioned corona discharger 63 prior to the ion current modulation. By the way, the screen which is capable of retention copying is not limited to that described in the foregoing embodiment. Also, whether or not retention copying is possible is arbitrary. The mode of modulation is also arbitrary, i.e., the modulation after the primary electrostatic latent image formation and the modulation simultaneous with the primary electrostatic latent image formation may, of course, be adopted.

What we claim is:

1. An image forming method for forming an image by modulation of ion current, comprising the steps of:

(a) modulating an ion current directed to a recording medium with an ion current modulating element to form an electrostatic latent image on said recording medium;

(b) uniformly charging said recording medium prior to said modulating step; and (c) controlling the electric potential of the electrostatic latent image to be formed on said recording medium by said modulating step by adjusting the potential of the charge applied to said recording medium by said charging step.

2. An image forming method as claimed in claim 1, wherein said recording medium including an insulating material, on a surface of which a latent image is formed by the modulation, and the latent image is developed into a developed image, which is then transferred onto another material.

3. An image forming method as claimed in claim 1, wherein said recording medium is a sheet-like material, on which a latent image is formed and developed.

4. An image forming method for forming an image by modulation of ion current, comprising the steps of:

(a) modulating an ion current directed to a recording medium with an ion current modulating element comprising a photosensitive body in the form of a screen by means of an electrostatic latent image formed thereon to thereby form an electrostatic latent image on said recording medium;

(b) uniformly charging said recording medium prior to said modulating step to the polarity opposite to that of the modulated ion current; and (c) controlling the electric potential of the electrostatic latent image to be formed on said recording medium by said modulating step by adjusting the potential of the charge applied to said recording medium by said charging step.

5. An image forming method for forming an image by modulation of ion current, comprising the steps of:

(a) modulating an ion current directed to a recording medium with an ion current modulating element comprising a photosensitive body in the form of a screen by means of an electrostatic latent image formed thereon to thereby form an electrostatic latent image on said recording medium;

(b) uniformly charging said recording medium prior to said modulating step by a corona discharger having grid means; and (c) controlling the electric potential of the electrostatic latent image to be formed on said recording medium by said modulating step by adjusting the potential of the charge applied to said recording medium by said charging step.

6. An image forming method as claimed in claim 5, wherein the adjustment of the potential of the charge applied on said recording medium by said charging step is carried out by varying the voltage applied to said grid means of said corona discharger.

7. An image forming method as claimed in claim 5, wherein said grid means is constructed with a plurality of thin wire electrodes; the interval between said electrodes and said recording medium is made substantially the same as that between mutually adjacent electrodes; and the width l of said corona discharge means with respect to the moving direction of said recording medium is so established as to satisfying the following equation: $l \geqq 4\ vdK/t$ (mm), where d denotes the interval between adjacent electrodes in "mm"; t represents the thickness of a chargeable layer of said recording medium in "microns"; K/t indicates an effective thickness in "microns"; K is the dielectricity; v is the moving speed of said recording medium in "cm/sec.".

8. An image forming method as claimed in claim 7, wherein the interval between said electrodes and said recording medium is between 0.7 to 2 times the interval between adjacent electrodes.

9. An image forming method as claimed in claim 8, wherein the interval between mutually adjacent thin wire electrodes is not more than 1.5 mm but not less than 0.5 mm.

* * * * *